US005489394A

United States Patent [19]

Ford et al.

[11] Patent Number: 5,489,394

[45] Date of Patent: Feb. 6, 1996

[54] SOLVENT COMPOSITIONS AND METHODS

[75] Inventors: William G. F. Ford; Tommy R. Gardner, both of Duncan, Okla.

[73] Assignee: Halliburton Company, Duncan, Okla.

[21] Appl. No.: 437,709

[22] Filed: May 9, 1995

(Under 37 CFR 1.47)

Related U.S. Application Data

[63] Continuation-in-part of Ser. No. 276,145, Jul. 18, 1994, abandoned.

[51] Int. Cl.[6] ..... C11D 1/66; C11D 1/02; C11D 3/44; C23G 5/024

[52] U.S. Cl. ..... 252/162; 252/558; 252/545; 252/557; 252/538; 252/142

[58] Field of Search ..... 252/558, 545, 252/557, 538, 162, 142

[56] References Cited

U.S. PATENT DOCUMENTS

| | | | |
|---|---|---|---|
| Re. 29,649 | 5/1978 | Farnsworth | 252/171 |
| 4,011,097 | 3/1977 | Sharp | 134/3 |
| 4,140,640 | 2/1979 | Scherubel | 252/8.55 |
| 4,483,783 | 11/1984 | Albanese | 252/312 |
| 4,511,488 | 4/1985 | Matta | 252/162 |
| 4,620,937 | 11/1986 | Dellutri | 252/143 |
| 4,704,225 | 11/1987 | Stoufer | 252/153 |
| 5,031,648 | 7/1991 | Lutener et al. | 134/632 |
| 5,277,836 | 1/1994 | Peters | 252/143 |
| 5,330,673 | 7/1994 | Bayless | 252/171 |

*Primary Examiner*—Dennis Albrecht
*Assistant Examiner*—Wyatt B. Pratt
*Attorney, Agent, or Firm*—Robert A. Kent

[57] ABSTRACT

The present invention relates to improved environmentally friendly solvent compositions for materials such as pipe dope, thread lubricants and the like and methods of utilizing such compositions. The nonaqueous solvent compositions are basically comprised of an emulsion of a surface active agent for breaking up and dispersing the materials, and D-limonene and a mixture of other terpenes including dipentene for dissolving the materials and glacial acetic acid.

8 Claims, No Drawings

SOLVENT COMPOSITIONS AND METHODS

CROSS-REFERENCE TO RELATED APPLICATION

The present application is a continuation-in-part of application Ser. No. 08/276,145 filed Jul. 18, 1994, now abandoned.

BACKGROUND OF THE INVENTION

1. Field of the Invention.

The present invention relates generally to solvent compositions and methods useful in removing materials such as pipe dopes and thread lubricants from surfaces, and more particularly, to improved such compositions and methods which are environmentally friendly.

2. Description of the Prior Art

In the completion and stimulation of oil and gas wells, materials such as pipe dopes, thread lubricants and the like are routinely removed from the surfaces of tubular goods, e.g., strings of threaded tubing and casing disposed in the well bores, prior to performing stimulation treatments, forming gravel packs, etc. If such materials are not removed, they can be carried into producing formations and reduce the production of hydrocarbons therefrom by plugging formation pores and flow channels.

For many years solvents including benzene, ethylbenzene, toluene and xylene have been utilized for removing pipe dopes and thread lubricants from tubular goods. Xylene or xylene bottoms are particularly effective in removing commercially available thread lubricants, pipe dopes including those containing metals and other similar materials. However, the use of solvents containing one or more of benzene, ethylbenzene, toluene and xylene has recently been restricted by various regulatory and environment protection agencies.

While various environmentally friendly commercial pipe dope and thread lubricant solvents have been developed and utilized heretofore, such solvents suffer from the disadvantage that they are not as effective as the previously used solvents which included benzene, ethylbenzene, toluene and/or xylenes. Thus, there is a need for improved solvent compositions and methods of using the compositions which are as effective or more effective than the previously used solvent compositions and which are environmentally friendly.

SUMMARY OF THE INVENTION

The present invention provides improved environmentally friendly solvent compositions and methods which meet the need described above and overcome the shortcomings of the prior art. The solvent compositions of the invention are basically comprised of a surface active agent for breaking up and dispersing materials such as pipe dopes, thread lubricants and the like and a mixture of terpenes predominantly including dipentene and D-limonene for dissolving the materials.

The compositions can optionally further include glacial acetic acid for reacting with metals and other reactive components in the materials to be removed, and the composition containing acetic acid can be formed into a stable emulsion.

The solvent compositions and the methods of using the compositions of this invention are highly effective in removing materials such as pipe dopes, thread lubricants and the like from surfaces such as the surfaces of tubular goods disposed in well bores, and the solvent compositions are environmentally friendly.

It is, therefore, a general object of the present invention to provide improved solvent compositions and methods for removing pipe dopes, thread lubricants and the like.

Other and further objects, features and advantages of the present invention will be readily apparent to those skilled in the art upon a reading of the description of preferred embodiments which follows.

DESCRIPTION OF PREFERRED EMBODIMENTS

The improved environmentally friendly nonaqueous solvent compositions of the present invention are particularly effective in removing materials such as commercial thread lubricants, metal containing pipe dopes and metal free pipe dopes. As mentioned, it is essential that such materials be removed from the surfaces of tubing and casing disposed in a well bore prior to performing producing formation stimulation treatments, forming gravel packs in the well or performing any other treatment or procedure whereby the materials may be carried into producing formations. If such materials are not removed they can be carried into producing formations or gravel packs whereby hydrocarbon flow pores and channels are plugged.

The improved environmentally friendly nonaqueous solvent compositions of the present invention are basically comprised of one or more surface active agents for breaking up and dispersing the materials to be removed by the solvent composition and a mixture of terpenes for dissolving the materials. Terpenes are unsaturated hydrocarbons having the formula $C_{10}H_{16}$ which may be either acyclic or cyclic with one or more benzenoid groups. They are highly effective solvents and are not harmful to the environment.

A particularly suitable mixture of terpenes for use in accordance with the present invention predominantly includes dipentene and D-limonene. Such a mixture which is presently preferred is comprised of a commercial mixture of dipentene and other terpenes from a paper pulping process and commercial D-limonene. The commercial mixture of dipentene and other terpenes from a paper pulping process is commercially available from the Halliburton Company of Duncan, Okla., under the trade designation "PARAGON 1 E+™" and has the following composition.

| Component | Volume % |
|---|---|
| dipentene | 25 |
| α-pinene | 17 |
| 1,4-cineole | 16 |
| 1,8-cineole | 11 |
| terpinolene | 10 |
| camphene | 8 |
| α-terpinene | 7 |
| γ-terpinene | 5 |
| para-cymene | 1 |
| | 100 |

The commercial D-limonene is available, for example, from the Florida Chemical Company of Lake Alfred, Fla.

While a variety of surface active agents will function to break up and disperse materials such as pipe dopes, thread lubricants and the like, particularly preferred such surfactants are those selected from the group consisting of an alkyl naphthalene sulfonate diisopropyl amine salt, sodium di-2-ethylhexyl sulfosuccinate and a blend of coco-diethanolamide and coco-sulfosuccinate. The alkyl naphthalene sulfonate diisopropyl amine salt surface active agent is commercially available, for example, from Champion Technologies, Inc. of Houston, Tex. The sodium di-2-ethylhexyl sulfosuccinate surface active agent is commercially available from Witco Chemical Company of Houston, Tex. The blend of coco-diethanolamide and coco-sulfosuccinate surface active agent is commercially available from Mona Chemical Company of Paterson, N.J.

A preferred nonaqueous solvent composition of the present invention which is a liquid blend is comprised of one of the surface active agents described above present in an amount in the range of from about 5% to about 25% by volume of the composition, D-limonene present in an amount in the range of from about 5% to about 90% by volume of the composition, and a mixture of other terpenes predominantly including dipentene present in an amount in the range of from about 5% to about 90% by volume of the composition.

The most preferred liquid blend solvent composition is comprised of an alkyl naphthalene sulfonate diisopropyl amine salt surface active agent present in an amount of about 15% by volume of the composition, D-limonene present in an amount of about 35% by volume of the composition, and a mixture of other terpenes predominantly including dipentene present in an amount of about 50% by volume of the composition.

The nonaqueous solvent compositions of this invention preferably include glacial acetic acid to react with metals and other reactive components in the pipe dopes and other materials to be removed and facilitate the dispersal of the materials. When glacial acetic acid is included, the solvent composition is preferably formed into an emulsion which prevents the acid from spending too quickly.

A preferred composition including acetic acid is comprised of a surface active agent of the type described above present in an amount in the range of from about 5% to about 25% by volume of the composition, D-limonene present in an amount in the range of from about 5% to about 90% by volume of the composition, a mixture of other terpenes predominantly including dipentene present in an amount in the range of from about 5% to about 90% by volume of the composition, and glacial acetic acid present in an amount in the range of from about 5% to about 25% by volume of the composition.

A particularly preferred emulsified nonaqueous solvent composition containing glacial acetic acid of this invention is comprised of a blend of coco-diethanolamide and coco-sulfosuccinate present in an amount of about 20% by volume of the composition, D-limonene present in an amount of about 10% by volume of the composition, a mixture of other terpenes predominantly including dipentene present in an amount of about 60% by volume of the composition, and glacial acetic acid present in an amount of about 10by volume of the composition.

It has been found that a particular mixing order must be followed if a stable emulsion of the composition of the present invention is to be formed. Initially, the D-limonene and mixture of terpenes are admixed. The surface active agent then is added to the mixture followed by the glacial acetic acid. Failure to admix the constituents in the above order results in an unstable mixture that rapidly separates. The unstable mixture fails to achieve the high degree of pipe dope removal effected by the stable emulsion prepared in accordance with the present invention.

The methods of the present invention are basically comprised of the steps of contacting surfaces having materials such as pipe dopes, thread lubricants and the like thereon with the nonaqueous solvent composition of this invention for a time period sufficient for the materials to be dissolved in the composition, and then removing the solvent composition containing the dissolved materials from the surfaces.

In removing materials such as commercial thread lubricants and pipe dopes with or without metal particles from the surfaces of tubing and casing disposed in a well bore, a nonaqueous solvent composition of the present invention can be circulated down the tubing and up the annulus between the tubing and the casing for a time period sufficient to remove the materials from the tubing and casing surfaces. During such circulation, small quantities of formation fluids, including water, may become admixed with the solvent, however such compositions remain substantially nonaqueous during the time period over which it removes the lubricants or pipe dopes. Other techniques can also be utilized such as pumping the nonaqueous solvent composition into the tubing and annulus, and after the required time period, displacing the solvent composition containing dissolved materials to the surface with produced fluids.

Generally, as is shown by the examples which follow, the nonaqueous solvent compositions of this invention are caused to contact surfaces containing the materials to be removed for time periods in the range of from about 5 minutes to about 20 minutes so that substantially all of the materials are dissolved in the solvent compositions.

As mentioned above, depending upon the particular materials to be removed, either a liquid blend nonaqueous solvent composition which does not contain acetic acid is utilized or a stable emulsified nonaqueous solvent composition containing acetic acid is utilized. Generally, the emulsified composition with acetic acid is utilized where the materials to be removed contain acid reactive materials such as metal particles and the like.

In order to further illustrate the solvent compositions and methods of this invention, the following examples are given.

EXAMPLE 1

Ten surface active agents were screened for use in solvent compositions for the removal of pipe dopes, thread lubricants and the like from surfaces. Because the solvents utilized in well bores would be contacted by brine, suitable surfactants were deemed to be those that were compatible with brine, i.e., did not form precipitates when contacted by brine. The screening of the surfactants was performed by adding 10% by volume of each surfactant tested to 90% by volume API brine in a 4 oz. jar, sealing the jar and shaking it by hand for 1 minute.

Descriptions of the surface active agents tested, and the results of the brine compatibility tests are set forth in Table I below.

TABLE I

Surface Active Agent Descriptions and Brine Compatibility

| Surface Active Agent Chemical Description | Trade Designation And Commercial Source | Brine Compatibility |
|---|---|---|
| Alkyl Naphthalene Sulfonate Diisopropyl Amine Salt | "P-1112 ™" Champion Technologies, Inc. of Houston, Texas | Miscible, no precipitate. Went from turbid to clear upon standing. |
| Sodium Di-2-ethythexyl Sulfosuccinate | "EMCOL 4500 ™" Witco Chem. Corp. of Houston, Texas | Miscible, no precipitate. Went from turbid to clear upon standing. |
| Blend of coco-diethanolamide and coco-sulfosuccinate | "MONAMULSE DL-1273 ™" Mona Industries, Inc. of Paterson, N.J. | Miscible, no precipitate. Went from turbid to clear upon standing. |
| Alkylaryl Sulfonic Acid | "WITCOLATE D51-29 ™" Witco Chem. Corp. of Houston, Texas | Milky, precipitate formed. |
| Phosphate Ester of Alkylaryl Ethoxylate | "EMPHOS CS-1361 ™" Witco Chem. Corp. of Houston, Texas | Milky, precipitate formed. |
| Polypropoxy Quaternary Ammonium Chloride | "EMCOL CC-36 ™" Witco Chem. Corp. of Houston, Texas | Milky, precipitate formed. |
| Alkanolamide | "WITCAMIDE 511 ™" Witco Chem. Corp. of Houston, Texas | Milky, precipitate formed. |
| Alkanolamide | "WITCAMIDE 5138 ™" Witco Chem. Corp. of Houston, Texas | Milky, precipitate formed. |
| Blend of anionic and nonionic surfactants | "MONAMULSE 653C ™" Mona Indus., Inc. of Paterson, N.J. | Milky, precipitate formed. |
| Mixture of mono and diphosphate esters | "MONAFAX 785 ™" Mona Indus., Inc. of Paterson, N.J. | Milky, precipitate formed. |

As shown in Table I only three surfactants passed the API brine compatibility tests, namely an alkyl naphthalene sulfonate diisopropyl amine salt, sodium di-2-ethylhexyl sulfosuccinate and a blend of coco-diethanolamide and coco-sulfosuccinate.

EXAMPLE 2

Thirty-one different solvent compositions, identified in Table II below, were obtained and/or prepared for evaluation. The first ten solvents, i.e., S1 through S10, were commercially available products. The last twenty-one solvents, i.e., S11 through S31, were laboratory prepared blends or emulsions comprised of the components in the amounts shown in Table II. The emulsion were prepared utilizing the mixing order previously described. Samples of solvents S11 through S31 were tested for brine compatibility utilizing the procedure set forth in Example 1 above. The results of the compatibility tests are given in Table II.

TABLE II

Solvent Compositions Tested

| Solvent Composition No. | Solvent Composition Description | Composition Type And Brine Compatibility |
|---|---|---|
| S1 | Reagent Grade Xylene | |
| S2 | Mixture of Saturated Hydrocarbons Equivalent to Naphtha | |
| S3 | "PARAGON 1 $E^+$ ™"[1] | |
| S4 | D-Limonene[2] | |
| S5 | "DIRT MAGNET ™"[3] | |
| S6 | "SUPER PICKLE ™"[3] | |
| S7 | "GOLD FLUSH ™"[4] | |
| S8 | "AQUET 280 ™"[5] | |
| S9 | "DOPE SOL ™"[6] | |
| S10 | "PDR 1000 ™"[7] | |
| S11 | 80% by volume of a mixture of terpenes ("PARAGON 1 $E^+$ ™")[1]; 15% by volume D-Limonene[2]; and 5% by volume of sodium di-2-ethylhexyl sulfosuccinate surface active agent[8]. | Blend; compatible with brine. |
| S12 | 80% by volume of a mixture of terpenes ("PARAGON 1 $E^+$ ™")[1]; 15% by volume D-Limonene[2]; and 5% by volume a blend of coco- | Blend; compatible with brine. |

TABLE II-continued

| Solvent Composition No. | Solvent Compositions Tested: Solvent Composition Description | Composition Type And Brine Compatibility |
|---|---|---|
| | diethanolamide and coco-sulfosuccinate surface active agents[9]. | |
| S13 | 80% by volume of a mixture of terpenes ("PARAGON 1 E+ ™")[1]; 15% by volume D-Limonene[2]; and 5% by volume alkylnaphthalene sulfonate diisopropyl amine salt surface active agent[10]. | Blend; compatible with brine. |
| S14 | 70% by volume of a mixture of terpenes ("PARAGON 1 E+ ™")[1]; 15% by volume D-Limonene[2]; 10% by volume unsaturated oleic acid[12]; and 5% by volume sodium di-2-ethylhexyl sulfosuccinate surface active agent[8]. | Blend; compatible with brine. |
| S15 | 70% by volume of a mixture of terpenes ("PARAGON 1 E+ ™")[1]; 15% by volume D-Limonene[2]; 10% by volume unsaturated oleic acid[12]; and 5% by volume a blend of coco-diethanolamide and coco-sulfosuccinate surface active agent[9]. | Blend; compatible with brine. |
| S16 | 70% by volume of a mixture of terpenes ("PARAGON 1 E+ ™")[1]; 15% by volume D-Limonene[2]; 10% by volume unsaturated oleic acid[11]; and 5% by volume alkyl naphthalene sulfonate diisopropyl amine salt surface active agent[10]. | Blend; compatible with brine. |
| S17 | 80% by volume of a mixture of terpenes ("PARAGON 1 E+ ™")[1]; 5% by volume D-Limonene[2]; 5% by volume sodium di-2-ethylhexyl sulfosuccinate surface active agent[8]; and 10% by volume glacial acetic acid. | Microemulsion; compatible with brine. |
| S18 | 80% by volume of a mixture of terpenes ("PARAGON 1 E+ ™")[1]; 5% by volume D-Limonene[2]; 5% by volume a blend of coco-diethanolamide and coco-sulfosuccinate surface active agent[9]; and 10% by volume glacial acetic acid. | Microemulsion; compatible with brine. |
| S19 | 80% by volume of a mixture of terpenes ("PARAGON 1 E+ ™")[1]; 5% by volume D-Limonene[2]; 5% by volume alkyl naphthalene sulfonate diisopropyl amine salt surface active agent[10]; and 10% by volume glacial acetic acid. | Microemulsion; compatible with brine. |
| S20 | 60% by volume of a mixture of terpenes ("PARAGON 1 E+ ™")[1]; 20% by volume sodium di-2-ethylhexyl sulfosuccinate surface active agent[8]; and 20% by volume glacial acetic acid. | Microemulsion; compatible with brine. |
| S21 | 60% by volume of a mixture of terpenes ("PARAGON 1 E+ ™")[1]; 20% by volume a blend of coco-diethanolamide and coco-sulfosuccinate surface active agent[11]; and 20% by volume glacial acetic acid. | Microemulsion; compatible with brine. |
| S22 | 60% by volume of a mixture of terpenes ("PARAGON 1 E+ ™")[1]; 20% by volume alkyl naphthalene sulfonate diisopropyl amine salt surface active agent[10]; and 20% by volume glacial acetic acid. | Microemulsion; compatible with brine. |
| S23 | 60% by volume of a mixture of terpenes ("PARAGON 1 E+ ™")[1]; 10% by volume D-Limonene[2]; 20% by volume sodium di-2-ethylhexyl sulfosuccinate surface active agent[8]; and 10% by volume glacial acetic acid. | Microemulsion; compatible with brine. |
| S24 | 60% by volume of a mixture of terpenes ("PARAGON 1 E+ ™")[1]; 10% by volume D-Limonene[2]; 20% by volume a blend of coco-diethanolamide and coco-sulfosuccinate surface active agent[9]; and 10% by volume glacial acetic acid. | Microemulsion; compatible with brine. |
| S25 | 60% by volume of a mixture of terpenes ("PARAGON 1 E+ ™")[1]; 10% by volume D-Limonene[2]; 20% by volume alkyl naphthalene sulfonate diisopropyl amine salt surface active agent[10]; and 10% by volume glacial acetic acid. | Microemulsion; compatible with brine. |
| S26 | 70% by volume of a mixture of terpenes ("PARAGON 1 E+ ™")[1]; 15% by volume D-Limonene[2]; and 15% by volume sodium di-2- | Blend; compatible with brine. |

TABLE II-continued

| Solvent Composition No. | Solvent Composition Description | Composition Type And Brine Compatibility |
|---|---|---|
| | Solvent Compositions Tested | |
| | ethylhexyl sulfosuccinate surface active agent[8]. | |
| S27 | 70% by volume of a mixture of terpenes ("PARAGON 1 E+ ™")[1]; 15% by volume D-Limonene[2]; and 15% by volume a blend of coco-diethanolamide and coco-sulfosuccinate surface active agent[9]. | Blend; compatible with brine. |
| S28 | 70% by volume of a mixture of terpenes ("PARAGON 1 E+ ™")[1]; 15% by volume D-Limonene[2]; and 15% by volume alkyl naphthalene sulfonate diisopropyl amine salt surface active agent[10]. | Blend; compatible with brine. |
| S29 | 50% by volume of a mixture of terpenes ("PARAGON 1 E+ ™")[1]; 35% by volume D-Limonene[2]; and 15% by volume sodium di-2-ethylhexyl sulfosuccinate surface active agent[8]. | Blend; compatible with brine. |
| S30 | 50% by volume of a mixture of terpenes ("PARAGON 1 E+ ™")[1]; 35% by volume D-Limonene[2]; and 15% by volume a blend of coco-diethanolamide and coco-sulfosuccinate surface active agent[9]. | Blend; compatible with brine. |
| S31 | 50% by volume of a mixture of terpenes ("PARAGON 1 E+ ™")[1]; 35% by volume D-Limonene[2]; and 15% by volume alkyl naphthalene sulfonate diisopropyl amine salt surface active agent[10]. | Blend; compatible with brine. |

[1]A mixture of terpenes predominantly dipentene commercially available under the trade designation "PARAGON 1 E+ ™" from Halliburton Co. of Duncan, Oklahoma.
[2]Commercially available from Florida Chemical Co. of Lake Alfred, Florida.
[3]Commercially available from Well-flow Tech. Inc. of Houston, Texas.
[4]Commercially available from Deep South Chemical & Supply Co. of Broussard, Louisiana.
[5]Commercially available from the Aquaness Corp. of Houston, Texas.
[6]Commercially available from Completion Fluids International of New Orleans, Louisiana.
[7]Commercially available from Rig Chemicals, Inc. of Homa, Louisiana.
[8]Witco Chemical Corp., "EMCOL 4500 ™".
[9]Mona Chemical Co., "MONAMULSE DL-1273 ™".
[10]Champion Technologies, Inc., "P-1112 ™".
[11]Akzo Chemicals, Inc., "NEO-FAT 94-06 ™".

Six commercially available pipe dopes described in Table III below were obtained for testing. As shown, the pipe dopes included two metal containing pipe dopes, two conventionally used proprietary mixture pipe dopes, and two metal free, environmentally safe pipe dopes.

TABLE III

| Pipe Dope No. | Pipe Dope Description | Trade Designation And Commercial Source |
|---|---|---|
| | Pipe Dopes Tested | |
| PD-1 | Proprietary Mixture | "LIQUID-O-RING300 ™" Oil Center Research, Inc. of Lafayette, LA. |
| PD-2 | Mixture of grease, oil, lead, zinc, copper, graphite, talc and lime | API MODIFIED Pipe Dope RSR Corporation of Dallas, TX. |
| PD-3 | Proprietary Mixture | "LUBON 404 ™" Oil Center Research, Inc. of Lafayette, LA. |
| PD-4 | Mixture of oil, soap, lead and copper | "KOPR-KOTE ™" Jet-Lube, Inc. of Houston, TX |
| PD-5 | Mixture of lithium, 12-OH stearate base grease, oil, talc, synthetic and amorphous graphite and polytetrafluoroethylene | "BESTOLIFE METAL FREE ™" RSR Corporation of Dallas, TX. |

TABLE III-continued

| Pipe Dope No. | Pipe Dope Description | Trade Designation And Commercial Source |
|---|---|---|
| | Pipe Dopes Tested | |
| | ("TEFLON ®"). | |
| PD-6 | Environmentally safe, metal free, petroleum base grease. | "LOS-MODIFIED ™" LUB-O-SEAL Co., Inc. of Houston, TX. |

EXAMPLE 3

The various solvent compositions set forth in Table II were tested to determine their effectiveness in removing the pipe dopes identified in Table III. The test procedure used was as follows.

A volume of 200 milliliters of the solvent composition to be tested was placed in a 300 milliliter beaker. A magnetic stirring bar was inserted, and the beaker was placed on a magnetic stirrer. Coupons cut from N-80 steel having dimensions of 6" (length)×2" (width)×⅛" (thickness) were utilized in the tests. A coupon was first weighed, and then a small amount of the pipe dope to be removed was smeared on the coupon on one side and at one end thereof. The coupon was reweighed to determine the exact weight of the pipe dope. Approximately 3 grams of pipe dope were used in each test. The coupon was then suspended in the solvent composition in the 300 milliliter beaker with the end containing the pipe dope submerged in the solvent composition. The solvent composition was agitated by the magnetic stirrer for 5 minutes at ambient conditions.

The coupon was then removed from the beaker and gently rinsed with distilled water. Excess water was blotted with a paper towel, and the coupon was dried in an oven at 200° F. for 15 minutes. After removing the coupon from the oven, it was allowed to cool to ambient temperature. A final weight was then determined and the percentage of pipe dope removed was calculated. If less than 100% of the pipe dope was removed, the test was repeated up to a maximum of 20 minutes in 5 minute intervals using the same coupon and the remaining pipe dope until the 20 minutes had expired or 100% of the pipe dope had been removed. The results of the tests are set forth in Tables IV through IX below.

TABLE IV

Percent Of Pipe Dope PD-1[13] Removed By Test Solvent Compositions

| | Percent Removed | | | |
|---|---|---|---|---|
| Solution | 5 Minutes | 10 Minutes | 15 Minutes | 20 Minutes |
| S1 | 37.9 | 79.3 | 100 | — |
| S2 | 27.2 | 56 | 79.5 | 90.1 |
| S3 | 37.6 | 69.1 | 87.5 | 91.3 |
| S4 | 32.7 | 57.8 | 72.1 | 74.6 |
| S5 | 1.3 | 5.3 | 6.6 | 9.7 |
| S6 | 10.6 | 29.6 | 41.2 | 51.2 |
| S7 | 11.5 | 35.1 | 49.8 | 58.4 |
| S8 | 35.1 | 62.7 | 79.4 | 84.2 |
| S9 | 25.6 | 48.2 | 61.5 | 70.1 |
| S10 | 22.3 | 38.4 | 50.2 | 57.1 |
| S11 | 45.5 | 63.2 | 79.0 | 92.8 |
| S12 | 31.0 | 59.0 | 72.0 | 87.7 |
| S13 | 29.3 | 55.6 | 78.6 | 94.4 |
| S14 | 16.1 | 33.9 | 50.3 | 71.9 |
| S15 | 14.6 | 29.4 | 44.9 | 60.9 |
| S16 | 23.6 | 47.3 | 70.3 | 86.9 |
| S17 | 57.4 | 79.3 | 94.4 | 97.7 |
| S18 | 67.4 | 92.9 | 98.7 | 100 |
| S19 | 56.5 | 66.3 | 72.9 | 75.1 |
| S20 | 70.0 | 98.4 | 100 | — |
| S21 | 80.6 | 93.9 | 100 | — |
| S22 | 70.3 | 88.1 | 94.1 | 95.7 |
| S23 | 67.4 | 93.8 | 100 | — |
| S24 | 68.2 | 98.7 | 100 | — |
| S25 | 61.0 | 85.6 | 98.1 | 99.4 |
| S26 | 29.4 | 58.4 | 81.3 | 92.3 |
| S27 | 25.6 | 51.9 | 80.7 | 96.2 |
| S28 | 31.7 | 62.4 | 80.1 | 89.9 |
| S29 | 41.2 | 74.4 | 92.7 | 97.0 |
| S30 | 42.5 | 80.2 | 95.9 | 96.2 |
| S31 | 42.0 | 86.9 | 98.7 | 99.0 |

[13]Oil Center Research, Inc., "LIQUID-O-RING 300 ™" Pipe Dope.

From Table IV it can be seen that none of the ten commercially available solutions S1 through S10 were effective in removing at least 90% of the "LIQUID-O-RING 300™" Pipe Dope in the first ten minutes. Solvent compositions S18, S20, S21, S23 and S24 removed at least 90% of the "LIQUID-O-RING 300™" within 10 minutes. Blend S24 was the most effective, removing 98.7% of the "LIQUID-O-RING 300™" in 10 minutes.

TABLE V

Percent Of Pipe Dope PD-2[14] Removed By Test Solvent Compositions

| | Percent Removed | | | |
|---|---|---|---|---|
| Solution | 5 Minutes | 10 Minutes | 15 Minutes | 20 Minutes |
| S1 | 96.6 | 99.0 | 100 | — |
| S2 | 59.3 | 80.2 | 94.0 | 100 |
| S3 | 64.0 | 82.6 | 84.6 | 88.1 |
| S4 | 80.7 | 99.3 | 100 | — |
| S5 | 0.0 | 0.0 | 0.0 | 1.3 |
| S6 | 53.3 | 70.7 | 83.3 | 92.1 |
| S7 | 36.9 | 76.5 | 79.4 | 87.3 |
| S8 | 26.2 | 43.7 | 50.0 | 54.3 |
| S9 | — | — | — | — |
| S10 | — | — | — | — |
| S11 | 59.4 | 84.6 | 95.2 | 98.2 |
| S12 | 84.7 | 94.8 | 96.6 | 96.6 |
| S13 | 68.4 | 83.6 | 89.5 | 95.4 |
| S14 | 24.7 | 46.7 | 70.1 | 83.2 |
| S15 | 30.6 | 58.6 | 68.4 | 93.8 |
| S16 | 40.1 | 65.2 | 85.8 | 96.4 |
| S17 | 40.1 | 47.9 | 53.8 | 56.0 |
| S18 | 39.0 | 58.0 | 69.8 | 74.8 |
| S19 | 40.3 | 53.6 | 60.7 | 62.7 |
| S20 | 50.3 | 72.3 | 82.9 | 87.1 |
| S21 | 40.8 | 65.0 | 75.2 | 83.0 |
| S22 | 54.8 | 73.8 | 81.6 | 85.9 |
| S23 | 47.2 | 75.6 | 93.5 | 98.4 |
| S24 | 32.4 | 54.3 | 82.9 | 96.8 |
| S25 | 52.4 | 81.6 | 96.1 | 96.4 |
| S26 | 45.0 | 78.0 | 88.1 | 93.0 |
| S27 | 39.9 | 80.4 | 96.1 | 96.8 |
| S28 | 59.2 | 89.2 | 96.7 | 99.0 |
| S29 | 55.9 | 93.5 | 99.7 | 100 |
| S30 | 59.9 | 97.4 | 100 | — |
| S31 | 68.3 | 92.7 | 97.5 | 97.5 |

[14]RSR Corporation, API MODIFIED Pipe Dope.

As shown in Table V above, reagent grade xylene, solvent composition S1, was effective in removing at least 90% of the API MODIFIED pipe dope in 5 minutes. Commercially available D-Limonene, S4, was effective in removing at least 90% of the pipe dope in 10 minutes. Solvent compositions S12, S29, S30 and S31 all removed at least 90% of the API MODIFIED Pipe Dope within 10 minutes.

TABLE VI

Percent Of Pipe Dope PD-3[15] Removed By Test Solvent Compositions

| | Percent Removed | | | |
|---|---|---|---|---|
| Solution | 5 Minutes | 10 Minutes | 15 Minutes | 20 Minutes |
| S1 | 51.9 | 89.7 | 98.6 | 100 |
| S2 | 26.7 | 44.0 | 57.7 | 74.9 |
| S3 | 24.6 | 50.2 | 71.7 | 88.5 |
| S4 | 39.9 | 74.1 | 92.0 | 100 |
| S5 | 2.6 | 3.3 | 4.3 | 6.9 |
| S6 | 14.0 | 27.6 | 37.5 | 54.0 |
| S7 | 12.4 | 22.4 | 27.6 | 40.5 |
| S8 | — | — | — | — |
| S9 | 30.5 | 57.8 | 76.3 | 90.6 |
| S10 | 24.2 | 42.1 | 56.3 | 70.2 |
| S11 | 24.0 | 44.0 | 63.7 | 78.3 |
| S12 | 25.5 | 40.9 | 59.2 | 76.8 |
| S13 | 22.3 | 43.0 | 65.1 | 82.9 |
| S14 | 11.3 | 26.2 | 38.2 | 56.0 |
| S15 | 7.6 | 20.7 | 35.0 | 49.0 |
| S16 | 17.8 | 29.1 | 44.3 | 59.2 |
| S17 | 13.0 | 21.4 | 27.9 | 35.6 |
| S18 | 19.5 | 36.0 | 49.7 | 62.0 |
| S19 | 15.4 | 23.6 | 28.5 | 34.8 |

TABLE VI-continued

| Percent Of Pipe Dope PD-3[15] Removed By Test Solvent Compositions | | | | |
|---|---|---|---|---|
| | Percent Removed | | | |
| Solution | 5 Minutes | 10 Minutes | 15 Minutes | 20 Minutes |
| S20 | 21.2 | 36.8 | 45.3 | 56.7 |
| S21 | 28.4 | 48.3 | 62.0 | 74.8 |
| S22 | 22.0 | 40.9 | 59.8 | 74.2 |
| S23 | 15.8 | 32.2 | 46.4 | 61.5 |
| S24 | 18.2 | 36.2 | 51.1 | 63.2 |
| S25 | 22.2 | 39.9 | 58.5 | 75.8 |
| S26 | 25.1 | 52.4 | 75.9 | 88.6 |
| S27 | 23.4 | 48.4 | 73.0 | 85.5 |
| S28 | 25.8 | 53.3 | 74.5 | 89.4 |
| S29 | 30.2 | 56.9 | 81.0 | 92.6 |
| S30 | 22.9 | 39.1 | 54.6 | 71.5 |
| S31 | 47.9 | 84.1 | 98.1 | 98.1 |

[15]Oil Center Research, Inc., "LUBON 404 ™" Pipe Dope.

As shown in Table VI, reagent grade xylene, S1, and commercial D-Limonene, S4, were effective in removing at least 90% of "LUBON 404™" thread lubricant in 15 minutes. Solvent composition S31 was effective in removing at least 90% of the "LUBON 404™" after 15 minutes and solvent composition S29 removed at least 90% of the lubricant after 20 minutes.

TABLE VII

| Percent Of Pipe Dope PD-4[16] Removed By Test Solvent Compositions | | | | |
|---|---|---|---|---|
| | Percent Removed | | | |
| Solution | 5 Minutes | 10 Minutes | 15 Minutes | 20 Minutes |
| S17 | 28.7 | 59.6 | 77.1 | 86.3 |
| S18 | 43.7 | 79.3 | 88.0 | 94.3 |
| S19 | 22.0 | 44.1 | 51.8 | 63.9 |
| S23 | 55.3 | 81.9 | 90.9 | 92.6 |
| S24 | 70.3 | 92.8 | 98.7 | 100 |
| S25 | 60.3 | 84.9 | 92.3 | 95.5 |
| S26 | 36.8 | 66.2 | 83.4 | 85.8 |
| S27 | 46.3 | 72.5 | 87.2 | 89.8 |
| S28 | 47.9 | 47.9 | 88.9 | 92.8 |
| S29 | 51.1 | 77.0 | 90.9 | 96.4 |
| S30 | 50.8 | 85.2 | 96.5 | 99.7 |
| S31 | 53.9 | 78.7 | 92.6 | 96.8 |

[16]Jet-Lube, Inc., "KOPR-KOTE ™" Pipe Dope.

As indicated in Table VII above, solvent composition S24 was effective in removing at least 90% of the "KOPR-KOTE™" Pipe Dope after 10 minutes. Solvent compositions S23, S25, S29, S30 and S31 were all effective in removing at least 90% of the pipe dope after 15 minutes. Solvent compositions S18 and S28 were effective in removing at least 90% after 20 minutes. The most consistent solvent compositions in removing the metal containing pipe dopes, i.e., API MODIFIED Pipe Dope (Table V) and "KOPR-KOTE™" Pipe Dope (Table VII) were solvent compositions S24 and S31.

TABLE VIII

| Percent Of Pipe Dope PD-5[17] Removed By Test Solvent Compositions | | | | |
|---|---|---|---|---|
| | Percent Removed | | | |
| Solution | 5 Minutes | 10 Minutes | 15 Minutes | 20 Minutes |
| S1 | 40.0 | 78.9 | 91.4 | 96.8 |
| S2 | 28.2 | 58.0 | 80.1 | 91.4 |
| S3 | 48.7 | 79.6 | 92.7 | 99.4 |
| S4 | 48.5 | 81.9 | 91.8 | 99.0 |
| S5 | 2.2 | 6.3 | 8.8 | 12.3 |
| S6 | 9.1 | 24.9 | 29.1 | 36.6 |
| S7 | 3.9 | 15.6 | 20.1 | 26.6 |
| S23 | 51.4 | 80.1 | 89.3 | 93.7 |
| S24 | 46.7 | 71.4 | 85.2 | 89.1 |
| S25 | 34.8 | 69.2 | 85.6 | 92.5 |
| S29 | 29.6 | 58.4 | 81.2 | 90.3 |
| S30 | 37.3 | 65.3 | 81.9 | 92.0 |
| S31 | 61.4 | 82.2 | 91.1 | 97.4 |

[17]RSR Corp., "BESTOLIFE METAL FREE ™" Pipe Dope.

As shown in Table VIII above, commercially available pipe dope solutions S1 through S7 were tested as well as solvent compositions S23–S31 in removing "BESTOLIFE METAL FREE™" Pipe Dope. Reagent Grade Xylene, S1, "PARAGON 1 E+", S3, and commercially available D-Limonene, S4, were all effective in removing at least 90% of the "BESTOLIFE" Pipe Dope after 15 minutes. Solvent composition S31 was effective in removing at least 90% after 15 minutes, while solvent compositions S23, S25, S29 and S30 all removed at least 90% of the pipe dope after 20 minutes.

TABLE IX

| Percent Of Pipe Dope PD-6[18] Removed By Test Solvent Compositions | | | | |
|---|---|---|---|---|
| | Percent Removed | | | |
| Solution | 5 Minutes | 10 Minutes | 15 Minutes | 20 Minutes |
| S1 | 81.8 | 92.7 | 99.7 | 100 |
| S2 | 38.9 | 55.5 | 71.3 | 81.2 |
| S3 | 19.8 | 26.4 | 38.9 | 43.3 |
| S4 | 74.9 | 84.0 | 94.8 | 97.7 |
| S5 | 2.6 | 4.8 | 10.3 | 13.8 |
| S6 | 14.6 | 21.6 | 33.2 | 35.2 |
| S7 | 34.4 | 67.9 | 79.7 | 87.9 |
| S23 | 31.2 | 46.1 | 62.0 | 74.4 |
| S24 | 40.3 | 63.2 | 81.9 | 90.7 |
| S25 | 68.9 | 83.4 | 95.4 | 97.4 |
| S29 | 65.1 | 82.2 | 87.5 | 93.4 |
| S30 | 61.3 | 76.7 | 86.7 | 92.3 |
| S31 | 64.6 | 80.0 | 85.6 | 88.5 |

[18]LUB-O-SEAL Co., Inc., "LOS-MODIFIED ™" Pipe Dope.

As shown in Table IX, Reagent Grade Xylene, S1, was effective in removing at least 90% of the environmentally safe, metal free "LOS-MODIFIED™" Pipe Dope after 10 minutes. Commercially available D-Limonene, S4, was effective in removing at least 90% of the pipe dope after 15 minutes. Solvent composition S25 was effective in removing at least 90% of the pipe dope after 15 minutes while blends S24, S9 and S30 were effective in removing at least 90% after 20 minutes.

From the various test results set forth above, it can be seen that the most effective solvent compositions overall were emulsions S23, S24 and S25 and liquid blends S29, S30 and S31 of the present invention. The most successful solvent compositions were emulsions S23, S24 and S25 of the present invention wherein the external phase of the emulsion was the terpene solvent mixture and the internal phase was glacial acetic acid. The data clearly demonstrates that not all terpenes or mixtures containing terpenes function in an equivalent manner to the nonaqueous solvent composition of the present invention.

All six of the solvent compositions of the present invention, i.e., emulsions S23, S24 and S25 and liquid blends S29, S30 and S31 were subjected to thermal stability tests at 200° F. in a hot water bath for 6 hours. There was no separation or layering out of the various components during this time period and no change in appearance was observed.

EXAMPLE 4

To demonstrate the importance of the mixing order to the formation of a stable emulsion, the following test was performed. Five samples were prepared in which the mixing order of the constituents were varied. The solvent constituents, identified as "Solvent" comprised D-Limonene and the mixture of terpenes described in solvent composition S24 of Example 3 in the amounts set forth for such composition. The surface active agent was a blend of coco-diethanolamide and coco-sulfosuccinate, identified as "Surfactant" and the acid was glacial acetic acid and was identified as "Acid" which were also present in the same amount as S24 of Example 3. The mixing order was as follows:

Sample 1: Solvent+Acid+Surfactant

Sample 2: Surfactant+Acid+Solvent

Sample 3: Acid+Solvent+Surfactant

Sample 4: Acid+Surfactant+Solvent

Sample 5: Solvent+Surfactant+Acid

The samples were placed in a hot water bath maintained at 150° F. Samples 1–4 each visibly separated within less than four hours. Sample 5 prepared in accordance with the present invention showed no visible signs of separation. Thus it is apparent that Samples 1–4 did not comprise a stable emulsion.

Thus, the present invention is well adapted to carry out the objects and attain the ends and advantages mentioned as those which are inherent therein. While numerous changes in the methods of the invention may be made by those skilled in the art, such changes are encompassed within the spirit of this invention as defined by the appended claims.

What is claimed is:

1. A process of making a stable nonaqueous nonseparating solvent composition for removing pipe dopes and thread lubricants from metal surfaces comprising the steps of:

forming an emulsion by admixing D-limonene and a mixture of other terpenes including dipentene with a surface active agent selected from the group consisting of an alkyl naphthalene sulfonate diisopropyl amine salt, sodium di-2-ethylhexyl sulfosuccinate and a blend of coco-diethanolamide and coco-sulfosuccinate, followed by adding glacial acetic acid, wherein said surface active agent is present in an amount in the range of from about 5% to about 25% by volume of said composition, said D-limonene is present in am amount in the range of from about 5% to about 90% by volume of said composition, said mixture of other terpenes including dipentene is present in the range of from about 5% to about 90% by volume of said composition, and said glacial acetic acid is present in an amount in the range of from about 5% to about 25% by volume of said composition.

2. The stable nonaqueous nonseparating solvent composition made by the process of claim 1.

3. The nonaqueous solvent composition of claim 1 wherein said mixture of other terpenes including dipentene is comprised of dipentene in an amount of about 25% by volume of said mixture, α-pinene in an amount of about 17% by volume of said mixture, 1,4-cineole in an amount of about 16% by volume of said mixture, 1,8-cineole in an amount of about 11% by volume of said mixture, terpinolene in an amount of about 10% by volume of said mixture, camphene in an amount of about 8% by volume of said mixture, α-terpinene in an amount of about 7% by volume of said mixture, γ-terpinene in an amount of about 5% by volume of said mixture and para-cymene in an amount of about 1% by volume of said mixture.

4. The nonaqueous solvent composition of claim 3 wherein said surface active agent is an alkyl naphthalene sulfonate diisopropyl amine salt present in an amount of about 15% by volume of said composition, said D-limonene is present in an amount of about 35% by volume of said composition and said mixture of other terpenes including dipentene is present in an amount of about 50% by volume of said composition.

5. The nonaqueous solvent composition of claim 2 wherein said surface active agent is a blend of coco-diethanolamide and coco-sulfosuccinate present in an amount of about 20% by volume of said composition, said D-limonene is present in an amount of about 10% by volume of said composition, said mixture of other terpenes including dipentene is present in an amount of about 60% by volume of said composition, and said glacial acetic acid is present in an amount of about 10% by volume of said composition.

6. A method of removing pipe dopes and thread lubricants from metal surfaces comprising the steps of:

contacting said metal surfaces with the composition made by the process of claim 1 for a time period sufficient for said pipe dopes and thread lubricants to be at least partially dissolved in said composition; and removing said composition from said surfaces.

7. The method of claim 6 wherein said mixture of other terpenes including dipentene is comprised of dipentene in an amount of about 25% by volume of said mixture, α-pinene in an amount of about 17% by volume of said mixture, 1,4-cineole in an amount of about 16% by volume of said mixture, 1,8-cineole in an amount of about 11% by volume of said mixture, terpinolene in an amount of about 10% by volume of said mixture, camphene in an amount of about 8% by volume of said mixture, α-terpinene in an amount of about 7% by volume of said mixture, γ-terpinene in an amount of about 5% by volume of said mixture and para-cymene in an amount of about 1% by volume of said mixture.

8. The method of claim 6 wherein said surface active agent is a blend of coco-diethanolamide and coco-sulfosuccinate present in an amount of about 20% by volume of said composition, said D-limonene is present in an amount of about 10% by volume of said composition, said mixture of other terpenes including dipentene is present in an amount of about 60% by volume of said composition, and said glacial acetic acid is present in an amount of about 10% by volume of said composition.

* * * * *